US010081035B2

(12) United States Patent
Campbell

(10) Patent No.: US 10,081,035 B2
(45) Date of Patent: Sep. 25, 2018

(54) DIRECTIONAL ATOMIZER SYSTEM FOR CLEANING CHANDELIERS

(71) Applicant: Inventive Solutions, LLC, East Kingston, NH (US)

(72) Inventor: Keith S. Campbell, East Kingston, NH (US)

(73) Assignee: Inventive Solutions, LLC, East Kingston, NH (US)

( * ) Notice: Subject to any disclaimer, the term of this patent is extended or adjusted under 35 U.S.C. 154(b) by 50 days.

(21) Appl. No.: 15/434,456

(22) Filed: Feb. 16, 2017

(65) Prior Publication Data

US 2017/0157652 A1 Jun. 8, 2017

Related U.S. Application Data

(60) Continuation-in-part of application No. 14/811,028, filed on Jul. 28, 2015, now Pat. No. 9,662,683, which
(Continued)

(51) Int. Cl.
*B08B 11/00* (2006.01)
*A47L 9/24* (2006.01)
(Continued)

(52) U.S. Cl.
CPC ..... *B08B 3/026* (2013.01); *A47L 7/00* (2013.01); *A47L 7/0095* (2013.01); *A47L 25/00* (2013.01); *B08B 3/04* (2013.01); *B08B 17/025* (2013.01)

(58) Field of Classification Search
CPC ..... B08B 3/026; B08B 3/04; B08B 17/025; A47L 7/00; A47L 7/095; A47L 25/00
See application file for complete search history.

(56) References Cited

U.S. PATENT DOCUMENTS 4,485,503 A 12/1984 Rolando et al.
4,494,433 A 1/1985 Gerber
(Continued)

FOREIGN PATENT DOCUMENTS

JP 06039354 2/1994
JP 07041841 7/1995
JP 2557937 9/1996

OTHER PUBLICATIONS

International Search Report and Written Opinion dated Feb. 10, 2012 for international patent application No. PCT/US2011/040841 with an international filing date of Jun. 17, 2011 in the name of the same applicant.
(Continued)

*Primary Examiner* — Dung Van Nguyen
(74) *Attorney, Agent, or Firm* — Nicholas Pfeifer; Smith & Hopen, P.A.

(57) ABSTRACT

An apparatus for cleaning chandeliers includes a hand-held fluid source having a proximal end connected to a source of hot water under positive pressure and a distal end having a spray head for discharging hot water under pressure in a spray pattern. A vacuum shield has at least one vacuum inlet connected to a source of negative pressure. Hot water discharged from the spray head is attracted to the vacuum shield when the spray head and the vacuum shield are disposed in relatively close proximity to one another and the vacuum shield is in fluid communication with the source of negative pressure. An object disposed between the spray head and the vacuum shield is cleansed by the action of hot water under positive pressure impinging against it. The vacuum shield protects objects not disposed between the spray head and the vacuum shield.

20 Claims, 10 Drawing Sheets

Related U.S. Application Data is a division of application No. 13/780,902, filed on Feb. 28, 2013, now Pat. No. 9,114,442, which is a division of application No. 12/817,625, filed on Jun. 17, 2010, now Pat. No. 8,402,596.

(51) Int. Cl.

| | |
|---|---|
| ***B08B 3/02*** | (2006.01) |
| ***A47L 7/00*** | (2006.01) |
| ***A47L 25/00*** | (2006.01) |
| ***B08B 3/04*** | (2006.01) |
| ***B08B 17/02*** | (2006.01) |

(56) References Cited

U.S. PATENT DOCUMENTS

| | | | | | |
|---|---|---|---|---|---|
| 5,206,970 | A | | 5/1993 | Johnson | |
| 5,472,005 | A | * | 12/1995 | Campbell | B08B 3/12 134/155 |
| 5,863,343 | A | * | 1/1999 | Campbell | B08B 3/12 134/1 |
| 6,494,315 | B2 | | 12/2002 | Frisk | |
| 7,866,332 | B1 | * | 1/2011 | Mizrahi | B66C 23/48 134/200 |
| 8,402,596 | B2 | * | 3/2013 | Campbell | A47L 7/00 15/302 |
| 8,404,055 | B2 | * | 3/2013 | Campbell | A47L 25/00 134/104.2 |
| 9,114,442 | B2 | | 8/2015 | Campbell | |
| 2003/0066547 | A1 | | 4/2003 | Burke et al. | |
| 2005/0204467 | A1 | | 9/2005 | Bean et al. | |
| 2006/0207018 | A1 | | 9/2006 | Lev et al. | |
| 2006/0218743 | A1 | | 10/2006 | Riske | |
| 2009/0133721 | A1 | | 5/2009 | Campbell | |

OTHER PUBLICATIONS

International Preliminary Report on Patentability dated Jan. 3, 2013 for international patent application No. PCT/US2011/040841 with an international filing date of Jun. 17, 2011 in the name of the same applicant.

* cited by examiner

DIRECTIONAL ATOMIZER SYSTEM FOR CLEANING CHANDELIERS

CROSS-REFERENCE TO RELATED APPLICATIONS

This nonprovisional application is a continuation-in-part of and claims priority to nonprovisional application Ser. No. 14/811,028, entitled "HAND-HELD TANK FOR CLEANING CHANDELIERS," filed Jul. 28, 2015, which is a division of and claims priority to nonprovisional application Ser. No. 13/780,902, entitled "HAND-HELD TANK FOR CLEANING CHANDELIERS," filed Feb. 28, 2013, issued on Aug. 25, 2015 as U.S. Pat. No. 9,114,442, which is a division of and claims priority to nonprovisional application Ser. No. 12/817,625, entitled "DIRECTIONAL ATOMIZER SYSTEM FOR CLEANING CHANDELIERS," filed Jun. 17, 2010, issued on Mar. 26, 2013 as U.S. Pat. No. 8,402,596, all by the same inventor.

BACKGROUND OF THE INVENTION

1. Field of the Invention

This invention relates, generally, to the art of cleaning chandeliers or other structurally complex lighting fixtures. More particularly, it relates to a system that cleans lighting fixtures without chemicals and that protects the electrical parts of the fixture from water and chemicals.

Description of the Prior Art

Conventional chandelier cleaning requires a labor-intensive, time-consuming dismantling of the chandelier and hand-washing of each part.

A major improvement in cleaning methods is disclosed in co-pending U.S. patent application Ser. No. 11/944,849, entitled "Method and Apparatus for Touchless Cleaning of a Chandelier" filed Dec. 17, 2007, by the present inventor. It discloses a tent-like structure that houses a chandelier so that it can be cleaned while still hanging from a ceiling. This substantially reduces the hours required to clean a chandelier. However, the electrical fixtures must be carefully covered during such cleaning, There is a need, therefore, for a chandelier cleaning apparatus and method that protects electrical sockets and connections during cleaning of a chandelier.

Conventional spray bottles rely on gravity to remove mixtures of chemicals, cold water, and dirt from the chandelier crystals and out of pooling areas. The area below a crystal or other chandelier part being cleaned is therefore soaked as that water drips. The floor or other surfaces such as tabletops below the part being cleaned must therefore be covered with a tarp or drop cloth. Floors and walls can still be marred by water as it splashes onto such tarps or drop cloths. The water, which may contain dissolved chemicals, may also damage the floor simply by flowing off the tarp or drop cloths because such protective sheets have little or no water containment ability.

Thus there is a need for cleaning chandeliers that does not depend upon the force of gravity and which does not result in pooling of water under a part that is cleaned.

Most manufacturers of spray bottle chemical chandelier cleaners warn users to avoid fume and spray inhalation, eye contact, skin contact, and the like.

Thus there is a need for a cleaning method that is safe to use.

Most chandelier arms, both new and antique, are held to the main frame of the chandelier by a potting material. Water is used to weaken the bond provided by the potting material when a chandelier arm is intentionally removed. Complete saturation of the potting material by chemical sprays also weakens the bond and loosens such arms when there is no intention to change them.

Thus there is a need for a process of cleaning chandeliers that does not use chemical sprays that weaken the bond of potting material.

Conventional fixtures that include hanging crystals may be submerged into a tank for cleaning using ultrasonic technology as disclosed by the present inventor in the above-identified co-pending patent application.

However, there is a need for a cleaning apparatus that can clean crystal parts of a new generation of fixtures that include crystals that are mounted in upright, diagonal, and sideways configurations, and the like.

Adhesives are also used on newer fixtures to bond glass, crystals, and other parts directly to the chandelier. These adhesives may or may not be weakened by chemical cleaning sprays. However, clear epoxy may be softened and discolored over time by the application thereto of chemical sprays.

Thus there is a need for a cleaning process that does not weaken adhesive bonds and that does not soften or discolor the clear epoxy used in chandeliers.

The use of a chemical spray bottle to clean a fixture requires spraying and re-spraying until the entire chandelier is drenched. Plastic bags are used to cover the bulb sockets. However, water and chemicals still pool in electrical junction boxes within the fixture and bowls that are common in chandeliers, thereby causing electrical shorts, corrosion, rusting, and other damage. The water can remain in such pools for days or weeks.

Thus there is a need for an improved method of cleaning chandeliers that does not cause such pooling.

There are no prior art chandelier systems that use only hot water and pressure to clean the entire fixture.

There is a need, therefore, for a chandelier cleaning system that uses only hot water under pressure to clean a chandelier.

There is also a need for a directional misting system as well.

However, in view of the prior art considered as a whole at the time the present invention was made, it was not obvious to those of ordinary skill how the identified needs could be met.

SUMMARY OF THE INVENTION

The long-standing but heretofore unfulfilled need for an improved method and apparatus for cleaning chandeliers and light fixtures is now met by a new, useful, and non-obvious invention.

The inventive structure is an apparatus for cleaning chandeliers. It includes a hand-held jet gun having a proximal end adapted to be connected to a source of hot water under positive pressure and a distal end having a spray head for discharging hot water under pressure in a spray pattern.

It also includes a vacuum shield having at least one vacuum inlet formed therein. The at least one vacuum inlet is adapted to be connected to a source of negative pressure.

Hot water discharged from the spray head is attracted to the vacuum shield when the spray head and the vacuum shield are held in relatively close proximity to one another and the vacuum shield is in fluid communication with the source of negative pressure.

An object disposed between the spray head and the vacuum shield is cleansed by the action of hot water under positive pressure impinging against it. The vacuum shield protects objects not disposed between the spray head and the vacuum shield from the hot water under positive pressure, in part by vacuum action that pulls hot water into the vacuum shield and in part by a physical shield.

The spray head is detachably mounted to the distal end of the hand-held jet gun. An elongate, hand-bendable barrel has a proximal end releasably connected to the distal end of the jet gun and has a spray head mounted on a distal end thereof so that a user may bend the elongate, hand-bendable barrel so that it may follow any preselected path of travel. This enables the spray head to be positioned in locations remote from the jet gun that would be difficult to reach in the absence of such elongate, hand-bendable barrel.

An embodiment of the vacuum shield includes a main body and a porous, absorbent cushioned pad that overlies the main body. The vacuum shield may also have a handle having a hollow interior that serves as a vacuum chamber. At least one bore is formed in the main body in interconnecting relation between the at least one vacuum inlet and the vacuum chamber. An elongate hose has a proximal end adapted to engage the source of negative pressure and a distal end adapted to engage the hollow handle to provide fluid communication between the at least one vacuum inlet and the source of negative pressure.

A plurality of upstanding bristles is formed on the cushioned pad. The bristles are operative to suppress splashing of water that impinges against the cushioned pad, to channel water impinging upon the cushioned pad to the at least one vacuum inlet, to remove at least one drop of water from a part being cleaned when the part is contacted by the bristles, and to cushion a fall of a part that lands atop the bristles.

An embodiment of the main body of the vacuum shield and the cushioned pad has a substantially common size and shape. An upstanding lip is formed about a periphery of the main body and a peripheral edge of the cushioned pad abuttingly engages the upstanding lip so that the cushioned pad is snugly held atop the main body by the upstanding lip.

An embodiment includes a spray shield in the form of generally vertical wall(s) extending upward from the vacuum shield. The vacuum shield includes a bottom surface sloping downwards to a drain aperture/vacuum inlet. The drain aperture is in communication with a telescoping drainage pipe that leads to a drainage tank. The drainage tank is preferably in fluid communication with a source of negative pressure. The telescoping drainage pipe allows the vacuum shield and spray shield to raise up partially around an object, such as a chandelier. When the object is disposed between the spray head and the spray shield, it can be cleansed by the action of hot water under positive pressure impinging against it. The spray shield and vacuum shield protect objects not disposed between the spray head and the vacuum shield from the hot water under positive pressure, in part by vacuum action that pulls hot water into the vacuum shield and in part by the spray shield.

An important object of the invention is to provide a chandelier cleaning apparatus that does not employ chemicals.

Another important object is to provide a chandelier cleaning apparatus that does not require the chandelier to be disassembled during cleaning.

Yet another important object is to provide a hands-free, touch free chandelier cleaning apparatus.

A more specific object is to disclose a cleaning apparatus that includes a hand-held jet gun for dispensing hot water under variable pressure and a vacuum shield that collects the hot water under vacuum and that physically protects objects positioned behind and beside it from said hot water.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
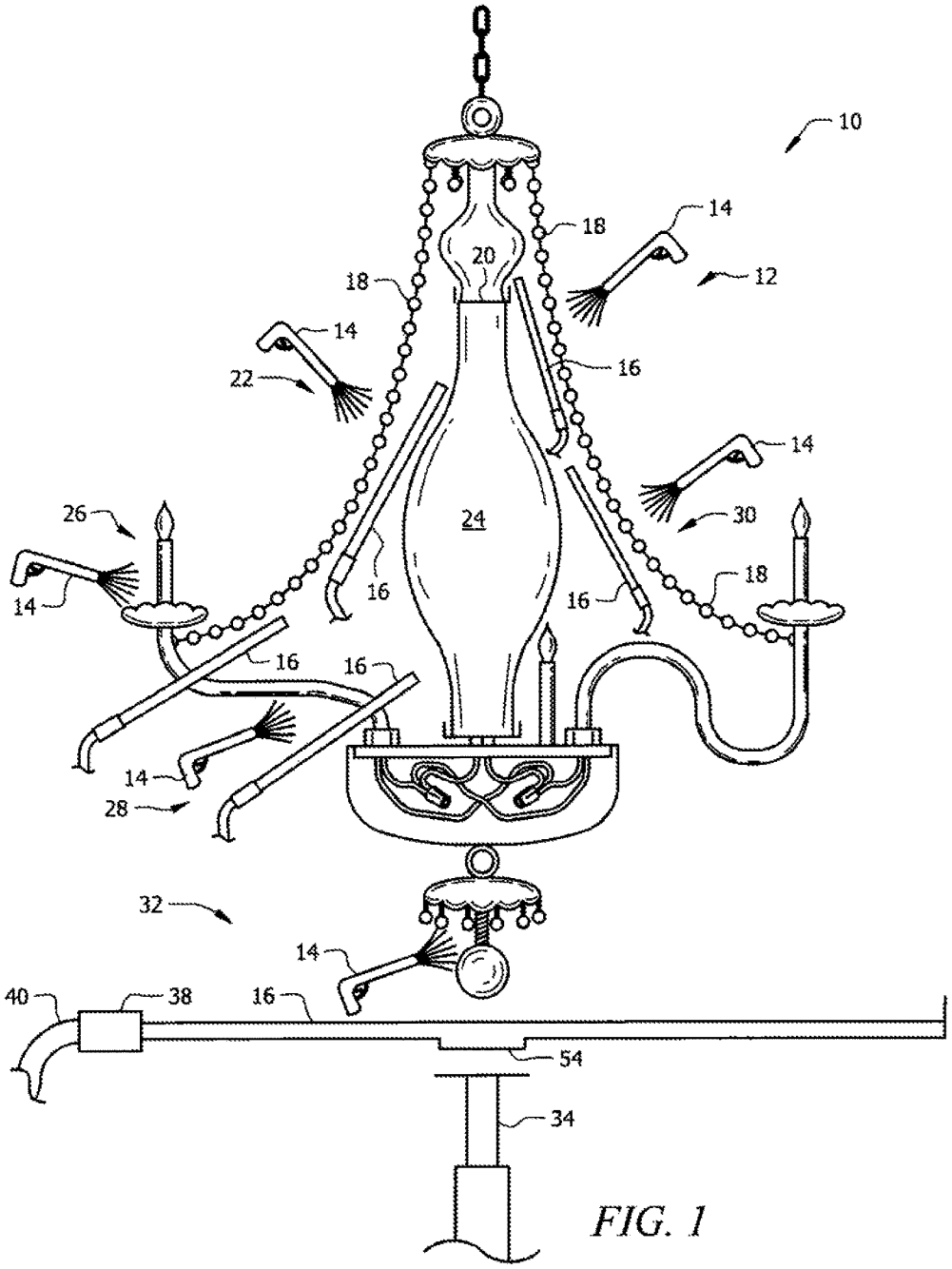
FIG. 1 is a diagrammatic side elevational view of a chandelier depicting multiple possible uses of the novel jet gun and vacuum shield.
Figure 2:
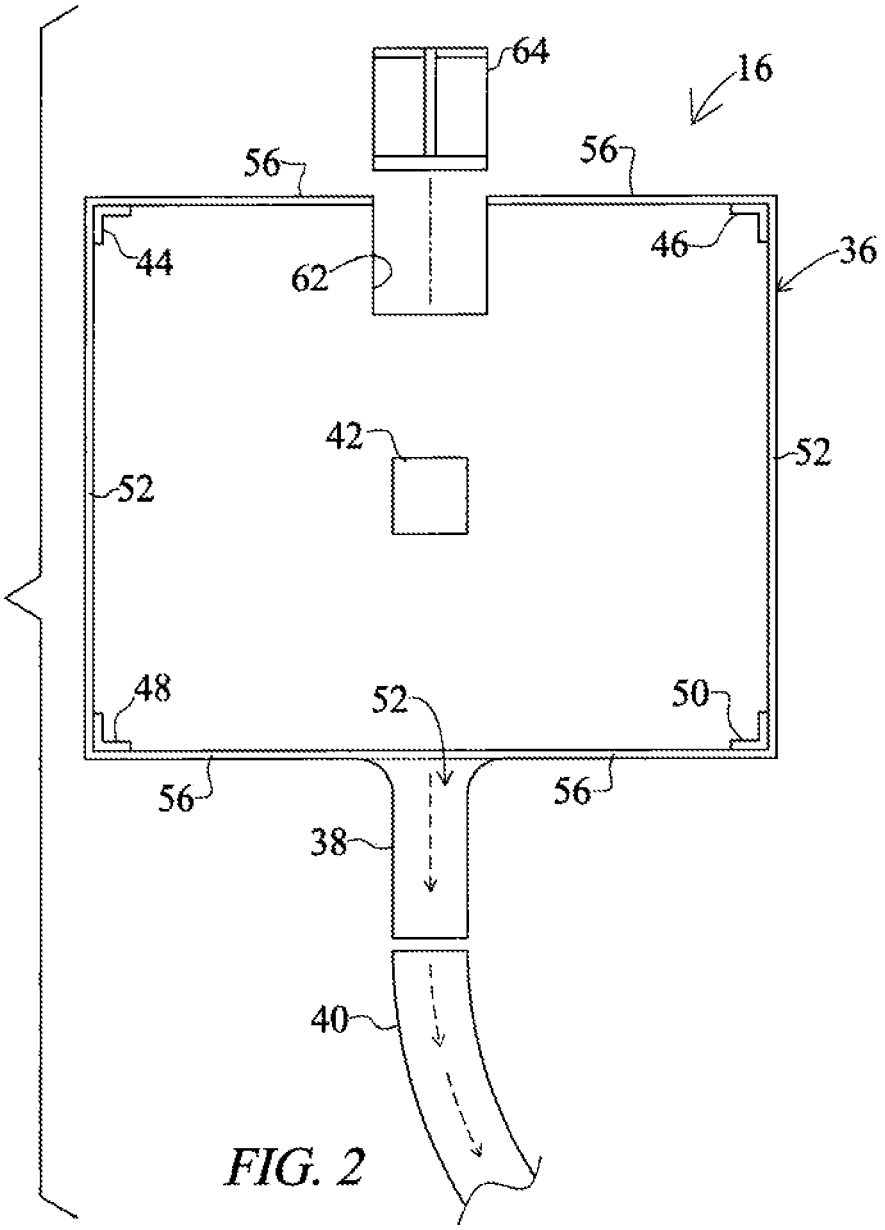
FIG. 2 is an exploded front elevational view of the novel vacuum shield.
Figure 3:
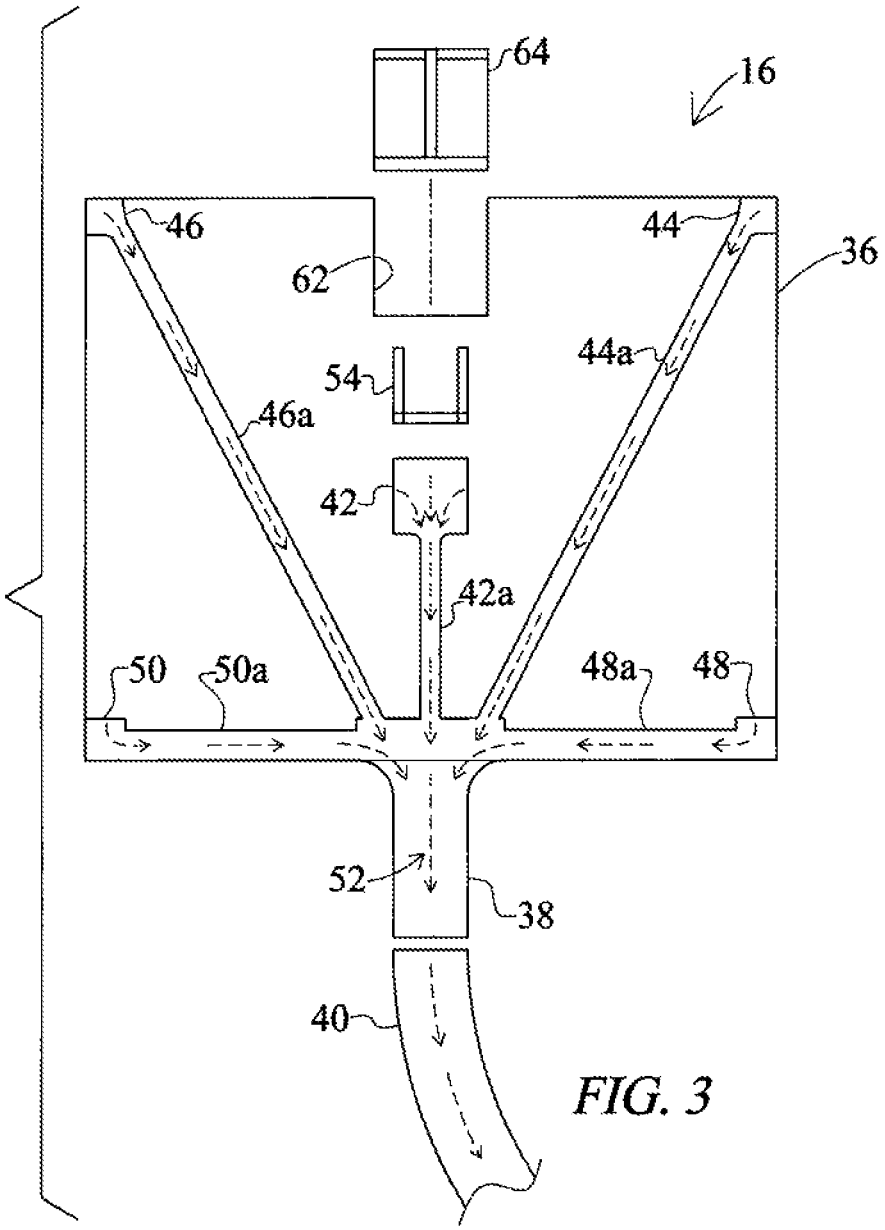
FIG. 3 is an exploded back elevational view of the novel vacuum shield.

Referring now to the detailed figures, an embodiment of novel vacuum shield 16, as depicted in FIGS. 1-12, has hollow handle 38 the interior of which forms vacuum chamber 52 that is in fluid communication with a vacuum pump. As depicted in FIG. 3, an embodiment includes vacuum chamber 52 in fluid communication with five (5) vacuum inlets formed in vacuum shield 16, there being one vacuum inlet in each corner and one in the center of the vacuum shield 16. The vacuum pulls into said hollow interior small particles of water or mist to prevent such small particles from impinging against electrical wires, various electrical connections, check rings, sockets, potting that holds arms, and the like. The vacuum captures and removes mist from inside, around, and under an area occupied by a light fixture. Vacuum shield 16 also physically shields such parts from mist as well.

Novel vacuum shield 16 is preferably used with a variable pressure mist jet that controls deflection of hot mist at temperatures in the range of about 140°-180° F.

In an embodiment, vacuum shield 16 is a paddle-like device that can be made in any shape such as round, square, concave and the like. It can be hand-held or it can be mounted to a tripod or other stand. It can be positioned around or under a fixture. It protects the fixture as well as surrounding areas from the mist emitted from the jet gun during the cleaning operation.

The vacuum shield includes detachable pads having bristles for cushioning falling crystals, deflecting mist, and for channeling excess mist to the vacuum intakes of the shield. This structure enables the operator to catch or collect mist from the side and horizontally.

An operator can use one or more vacuum shields 16 at the same time, such as positioning a first shield in underlying relation to a fixture while holding a second shield in and around a fixture. A single shield can be used to clean as few as one crystal at a time or as many as a hundred crystals at a time.

The novel system further includes a plant or power unit that houses a source of hot water, a vacuum component, and a used water retrieval system.

Referring now to FIG. 1, it will there be seen that a diagrammatic representation of a chandelier is denoted as a whole by the reference numeral 10.

FIG. 1 also includes six (6) examples of how the novel jet gun and vacuum shield may be used in cleaning various parts of chandelier 10.

As indicated by the reference numeral 12, novel jet gun 14 and novel vacuum shield 16 are positioned on opposite sides of a string of crystals 18 in the vicinity of check ring 20. Vacuum shield 16 is positioned in shielding relation to said check ring 20 so that water can not enter into said check ring and inside the center stem, thereby preventing pooling of water within said check ring as happens when prior art equipment and methods are used.

Reference numeral 22 indicates the respective positions of jet gun 14 and vacuum shield 16 when said shield is used to protect central part 24 of chandelier 10.

Reference numeral 26 indicates the respective positions of jet gun 14 and vacuum shield 16 when said shield is used to protect a floor area directly below a chandelier part being cleaned.

Reference numeral 28 indicates the respective positions of jet gun 14 and vacuum shield 16 when shield 16 is used to protect arm potting and to prevent water pooling in electrical areas.

The respective positions of jet gun 14 and vacuum shield 16 when vacuum shield 16 is used to protect protruding light sockets is denoted generally by the reference numeral 30.

The respective positions of jet gun 14 and vacuum shield 16 when shield 16 is used to protect furniture and flooring beneath a chandelier as a whole is denoted by the reference numeral 32. In this embodiment, vacuum shield 16 has a size sufficient to underlie the entirety of chandelier 10. Floor or table-supported upright stand 34 is used to hold said vacuum shield 16.

Jet gun 14 is sized to fit within a human hand so that an operator can reach into a fixture to gain access to the back of a crystal and other parts that are inaccessible from the outside of the fixture. The small size of the jet gun also helps the operator avoid contact with electrical components. Jet gun 14 has a thumb or finger regulator for control of water pressure that is formed like a trigger and positioned so that it is comfortable and easy to operate. A loop system in jet gun 14 reheats mist that is delivered to the jet gun from a remote source because the mist cools in long hose 40 that interconnects the hot mist source and the jet gun. Small amounts of mist at 140°-180° F. are needed at spaced apart time intervals when the jet gun is in use.

Figure 4:
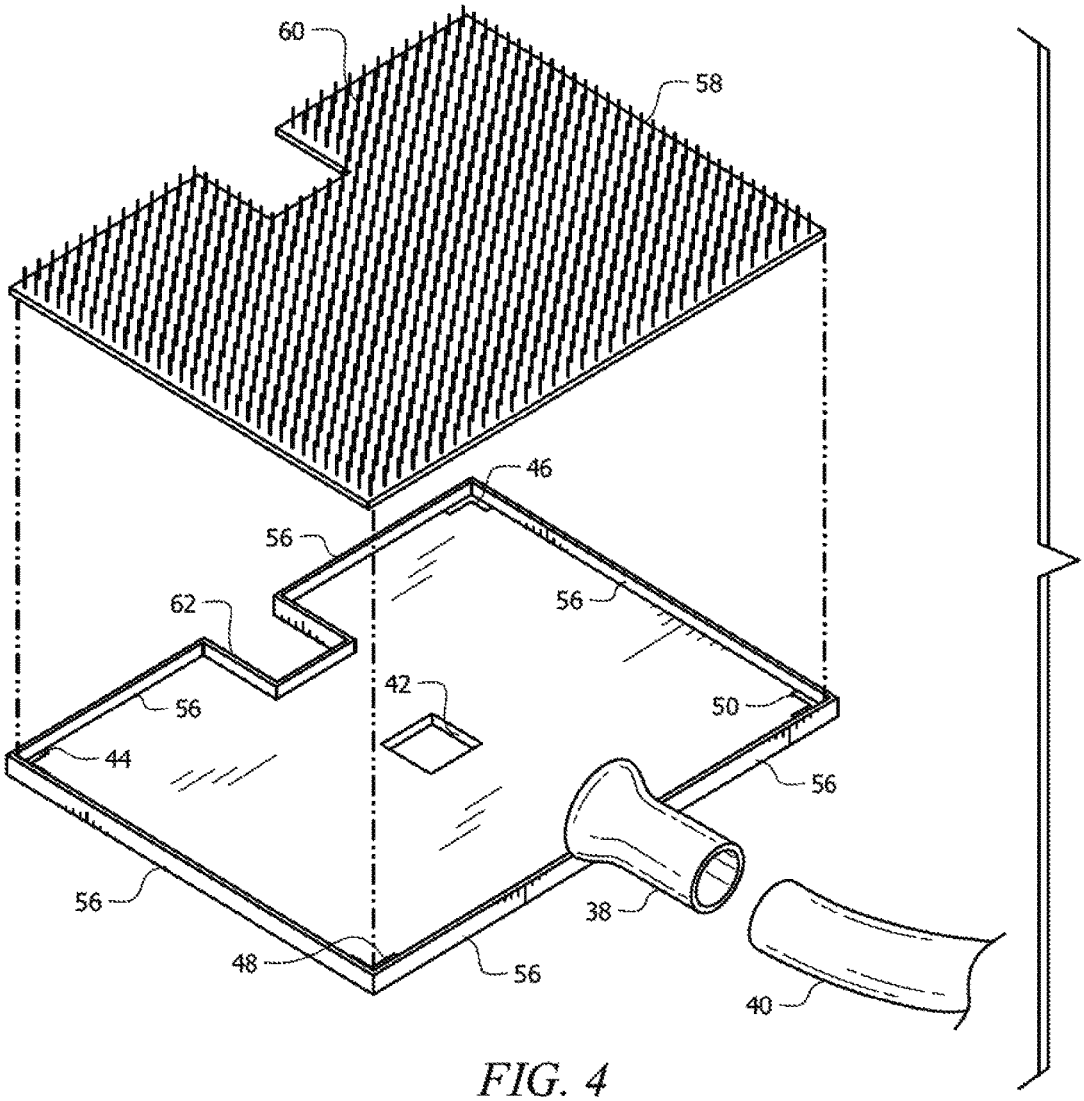
FIG. 4 is an exploded perspective view of the novel vacuum shield.

An embodiment of novel vacuum shield 16 is depicted in increased detail in FIGS. 2-4. In FIG. 2, it will there be seen that vacuum shield 16 has a generally square or rectangular main body 36 and handle 38 formed integrally therewith about mid-length of one of the sides. However, shield 16 may also have a main body 36 that is round or of any other practical geometric configuration. Handle 38 is adapted to releasably engage elongate vacuum hose 40 that is in selective fluid communication with a source of negative pressure, not depicted.

The preferred embodiment includes five vacuum inlets formed in main body 36 but a structure having one vacuum inlet only is within the scope of this invention, as are embodiments having more than one, fewer than five, or more than five. Central vacuum inlet 42 is preferably square in shape and is positioned in the center of main body 36. Vacuum inlets 44, 46, 48, and 50 have two (2) arms of equal length disposed at ninety degree (90°) angles to one another and each is disposed in a corner of main body 36.

As depicted in FIG. 3, all five (5) vacuum inlets are in fluid communication with the interior of vacuum junction box 52. More particularly, channel **46*a* provides fluid communication between vacuum inlet 46 and the interior of said vacuum junction box, channel 44*a* provides fluid communication between vacuum inlet 44 and the interior of said vacuum junction box, channel 50*a* provides fluid communication between vacuum inlet 50 and the interior of said vacuum junction box, channel 48*a* provides fluid communication between vacuum inlet 48 and said interior, and channel 42*a* provides fluid communication between central vacuum inlet 42** and said interior.

Item 54 in FIG. 1 is a bracket to which stand 34 (FIG. 1) may be attached.

As best understood in connection with FIG. 4, an upstanding lip or thin wall 56 is formed about the periphery of the front side of vacuum shield 16. Said lip 56 has a height substantially equal to a thickness of flexible flat pad 58 that is sized to overlie the front wall of main body 36 and to fit snugly within the confines of peripheral lip 56. Plastic bristles, collectively denoted 60, are secured to flat pad 58 and extend upwardly therefrom as depicted. Lip 56 channels water to side vacuum inlets 44, 46, 48, 50.

Figure 5A:
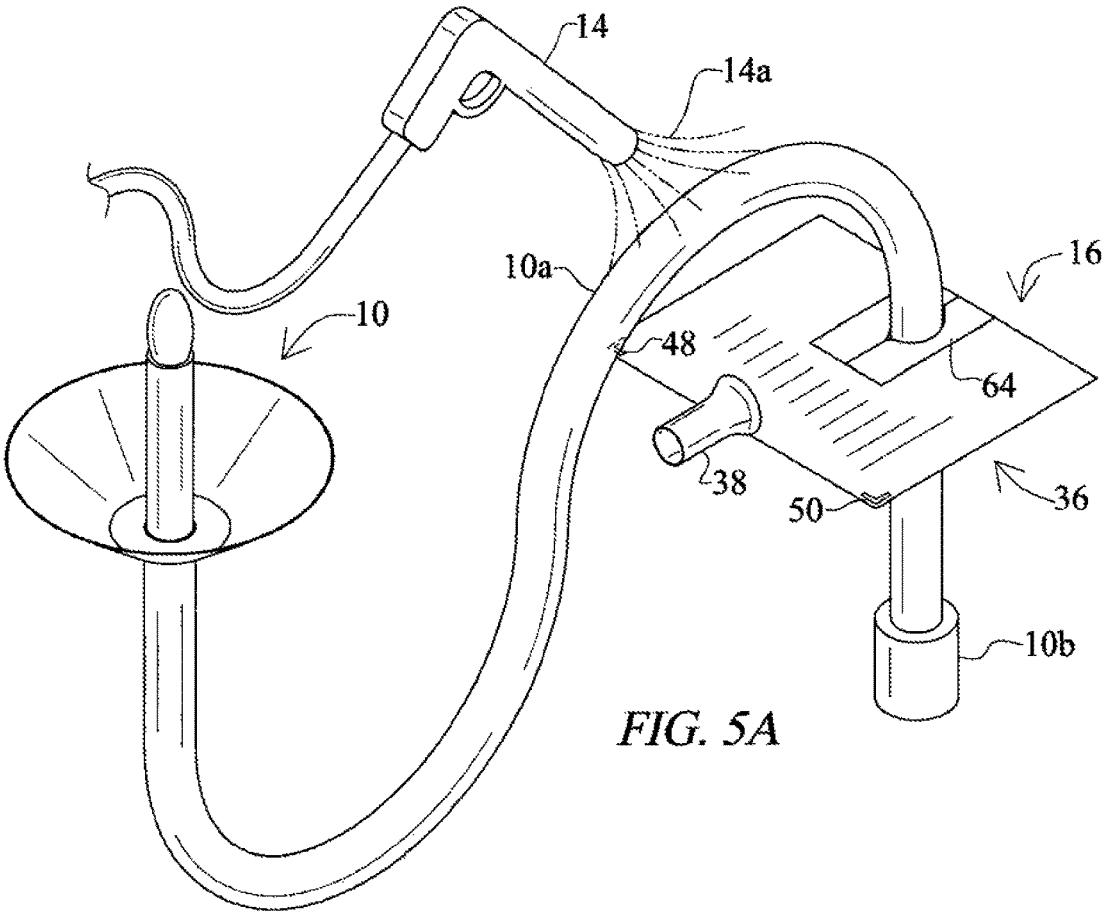
FIG. 5A is a perspective view of the novel vacuum shield when its rubber door is sealingly engaged around a chandelier arm.

A square or rectangular cut out area 62 is formed in main body 36 in open communication with one of the sides of shield 16, preferably the side opposite handle 38 as depicted. Door panel 64, depicted in FIGS. 2, 3 and 5A, is sized to snugly fit within said cut out area. It is made with soft rubber or other suitable flexible and resilient elastomeric material and has a substantially rigid frame made of wire, plastic or other suitable material.

FIG. 5A depicts chandelier arm 10*a* of chandelier 10 extending through door 64. The soft rubber of the door conforms to the shape of said arm 10*a* and closes around it tightly to prevent hot water 14*a* emitted under pressure by jet gun 14 from passing through said door panel 64. Accordingly, vacuum shield 16 protects whatever parts of the chandelier may be behind it. In the example of FIG. 5A, vacuum shield 16 protects potting 10*b* at free end of chandelier arm 10*a* from water run off.

Figure 5B:
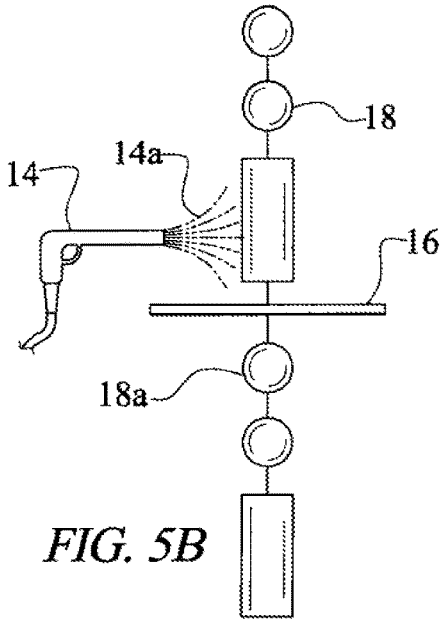
FIG. 5B is a side elevational view of the novel vacuum shield when its rubber door is sealingly engaged around a wire that forms a part of a chain of crystals.

FIG. 5B depicts a chain of crystals 18 that are strung along a wire 18*a* or pins that extends through door 64. The soft rubber of door 64 conforms to wire 18*a* and closes around it tightly to prevent hot water 14*a* emitted under pressure by jet gun 14 from passing through said door 64. Accordingly, vacuum shield 16 protects whatever parts of the chandelier may be under it. In the example of FIG. 5B, vacuum shield 16 protects the crystals below the plane of vacuum shield 16.

Figure 6:
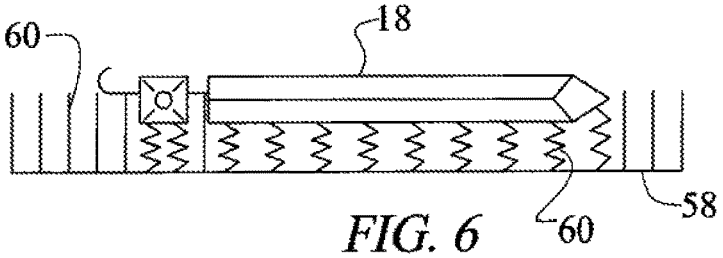
FIG. 6 is a side elevational view of the novel vacuum shield when supporting a fallen crystal.

Bristles 60 perform multiple functions. When vacuum shield 16 is positioned in a horizontal plane with the bristle side facing upwardly, as depicted in FIG. 6, bristles 60 cushion the fall of any crystal 19 that may fall from chandelier 10 during the cleaning process. The bristles that support the weight of such crystal 18 may be slightly collapsed or deformed from their respective positions of repose as depicted in said FIG. 6.

Figure 7:
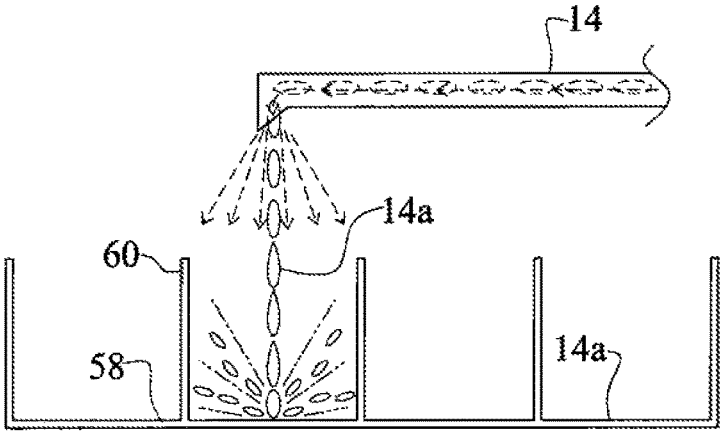
FIG. 7 is an enlarged side elevational view of the novel vacuum shield.

The height of bristles 60 is sufficient to contain or at least suppress to some extent splashing of water 14*a* emitted by jet gun 14 as said water hits pad 58 as indicated in the enlarged view of FIG. 7.

Figure 8:
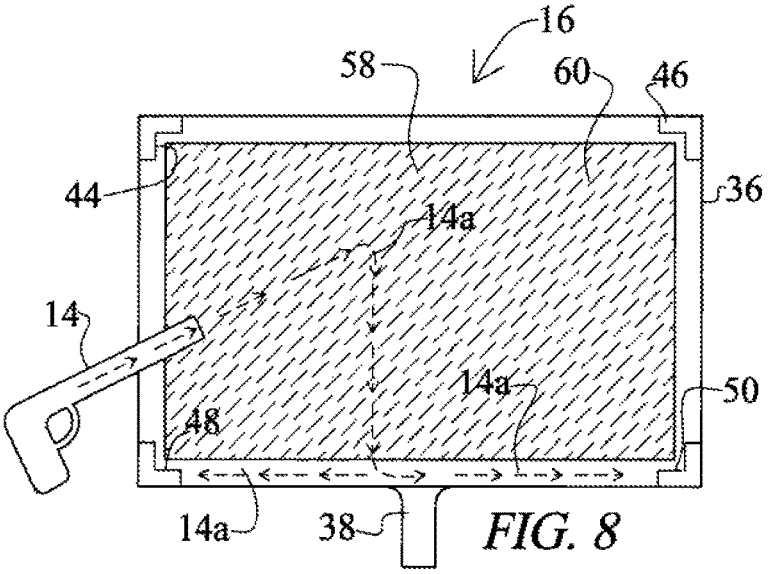
FIG. 8 is a front elevational view of the novel vacuum shield.

FIG. 8 depicts how water 14*a* emitted by jet gun 14 is guided or channeled by bristles 60 to the various vacuum inlets 42, 44, 46, 48, and 50.

Figure 9:
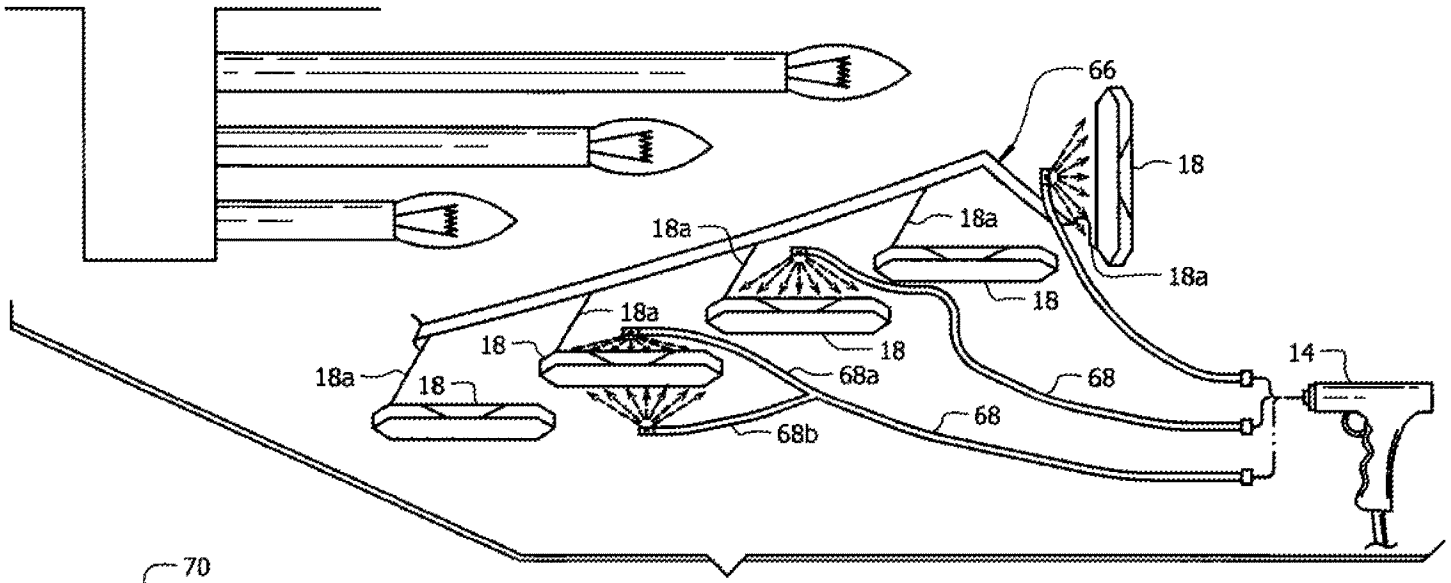
FIG. 9 is a side elevational view of a plurality of horizontal electrical fixtures where electrical sockets are above the crystal and depicting multiple configurations of an elongate, bendable atomizer.

Novel jet gun 14 and vacuum shield 16 also have utility in the context of horizontal light fixtures of the type depicted in FIG. 9. In this type of chandelier, the electrical sockets and bulbs are horizontal and the crystals are below them as depicted. FIG. 9 thus indicates how crystals 18 in this style of chandelier are cleaned while protecting electrical components from damage.

More particularly, FIG. 9 is a composite view that depicts multiple configurations of the novel apparatus. In the embodiment of FIG. 1, jet gun 14 is depicted as having an elongate barrel. FIG. 9 indicates that said barrel is releasably engaged to the main body of the jet gun so that multiple barrels of differing lengths may be attached to the main body of the jet gun for differing applications. FIG. 9 also indicates that the barrel is bendable along its length to further enhance the utility of the novel apparatus.

More particularly, FIG. 9 depicts four (4) horizontal crystals and one (1) vertical crystal, each of which is mounted to frame 66 of a chandelier by a wire 18*a*. Crystal 18 at the left end of FIG. 9 is clean. Crystal 18 to the immediate right of said clean crystal is being cleaned by a bifurcated elongate barrel 68 having forks 68*a*, 68*b* that are simultaneously cleaning the top and bottom surfaces of said crystal, respectively. Crystal 18 to the immediate right of said crystal is being cleaned on its top surface only by a non-bifurcated barrel that has a plurality of ninety degree (90°) bends formed therein along its length as necessitated by its difficult-to-reach position. The next crystal is not being cleaned. The vertical crystal is being cleaned by an elongate barrel having a gradual bend formed therein so that it can reach behind said vertical crystal as depicted.

Figure 10A:
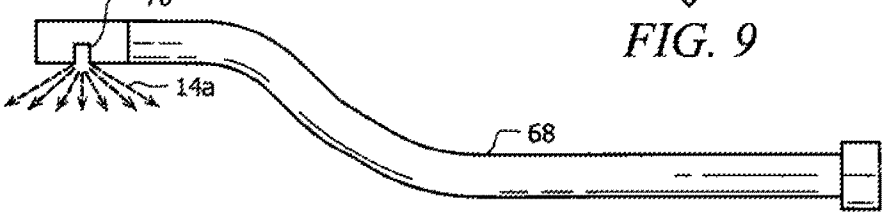
FIG. 10A is an enlarged side elevational view of a first embodiment of an atomizer.

FIG. 10A depicts an elongate, flexible barrel 68 having nozzle 70 that dispenses water 14*a* in a spray, the center of which is at a ninety degree (90°) degree angle relative to a longitudinal axis of said barrel. Barrel branch 68*a* in FIG. 9 includes nozzle 70, as does the barrel having multiple ninety degree (90°) bends formed therein to the immediate right of said barrel and as does the barrel cleaning the vertical crystal in said FIG. 9.

Figure 10B:
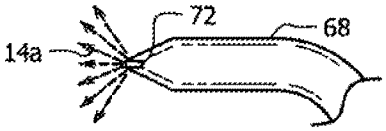
FIG. 10B is an enlarged side elevational view of a second embodiment of an atomizer.

FIG. 10B depicts an elongate, flexible barrel 68 having nozzle 72 that dispenses water in a spray, the center of which is coincident with a longitudinal axis of the barrel.

Novel atomizer 68 is a combination spray head and wand. Spray head 70 or 72 is integrally formed in the distal end of an elongate, hand-bendable tube that can be bent in any direction. The bending can be at the distal end only, the proximal end only, or any location or multiple locations therebetween. The proximal end of the elongate tube is attached to jet gun 14 so that the operator can insert the atomizer through small openings between crystals and other openings to access the back of a fixture for cleaning purposes. This avoids the prior art need to disassemble a light fixture during a cleaning process.

Atomizer 68 lacks sharp edges that could engage parts of the light fixtures as it is withdrawn though narrow openings. It is insulated by rubber or other suitable material so that it can be handled by an operator even when dispensing mist at 140°-180° F.

Figure 11:
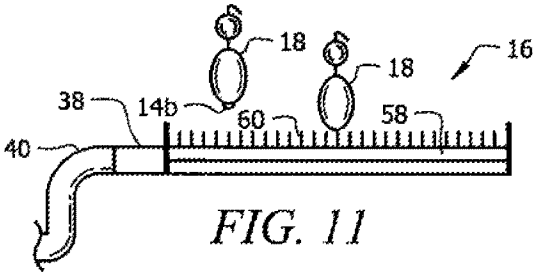
FIG. 11 is a side elevational view depicting the novel vacuum shield when used as a dauber.

FIG. 11 depicts novel interchangeable pad 58 having bristles 60 that can also be used as a dauber to remove mist that may collect on the bottom or lowermost end of a crystal or other item being cleaned. A drop of water 14*b* clings to the bottom of crystal 18 that is not in contact with vacuum shield 16. That drop is removed by contact with bristles 60 of vacuum shield 16 as indicated by the crystal in contact with said bristles. Touching such mist with the shield reduces or eliminates spots that may otherwise form on such lowermost locations.

Figure 12A:
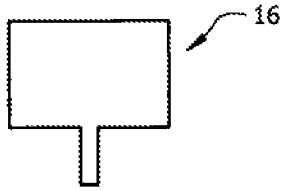
FIG. 12A is a front elevational view of a rectangular vacuum shield without a rubber door.
Figure 12B:
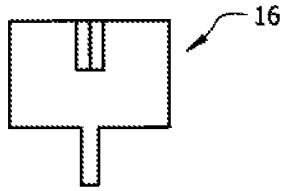
FIG. 12B is a front elevational view of a rectangular vacuum shield with a rubber door.
Figure 12C:
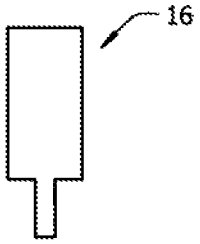
FIG. 12C is a front elevational view of a rectangular vacuum shield having a height or length that exceeds its width.
Figure 12D:
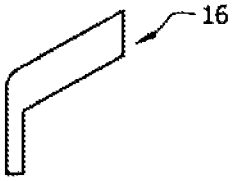
FIG. 12D is a side elevational view depicting a vacuum shield of flat configuration that is positioned at an angle to its handle.
Figure 12E:
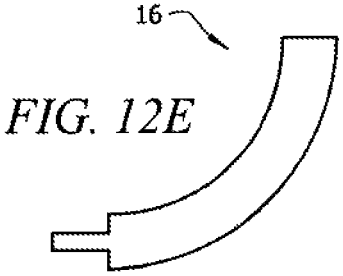
FIG. 12E is a side elevational view depicting a vacuum shield of arcuate configuration.
Figure 12F:
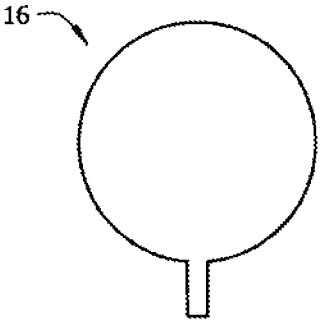
FIG. 12F is a front elevational view of a vacuum shield having a flat, round configuration.
Figure 12G:
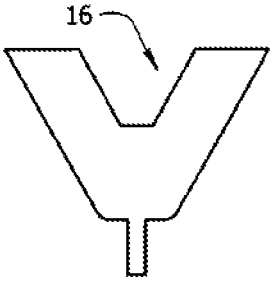
FIG. 12G is a front elevational view of a vacuum shield having a flat, bifurcated configuration that forms a general "Y" shape.

FIG. 12A is a front elevational view of a rectangular vacuum shield without a rubber door, FIG. 12B is a front elevational view of a rectangular vacuum shield with a rubber door, FIG. 12C is a front elevational view of a rectangular vacuum shield having a height or length that exceeds its width, FIG. 12D is a side elevational view depicting a vacuum shield of flat configuration that is positioned at an angle to its handle, FIG. 12E is a side elevational view depicting a vacuum shield of arcuate configuration, FIG. 12F is a front elevational view of a vacuum shield having a flat, round configuration, and FIG. 12G is a front elevational view of a vacuum shield having a flat, bifurcated configuration that forms a general "Y" shape.

Figure 13:
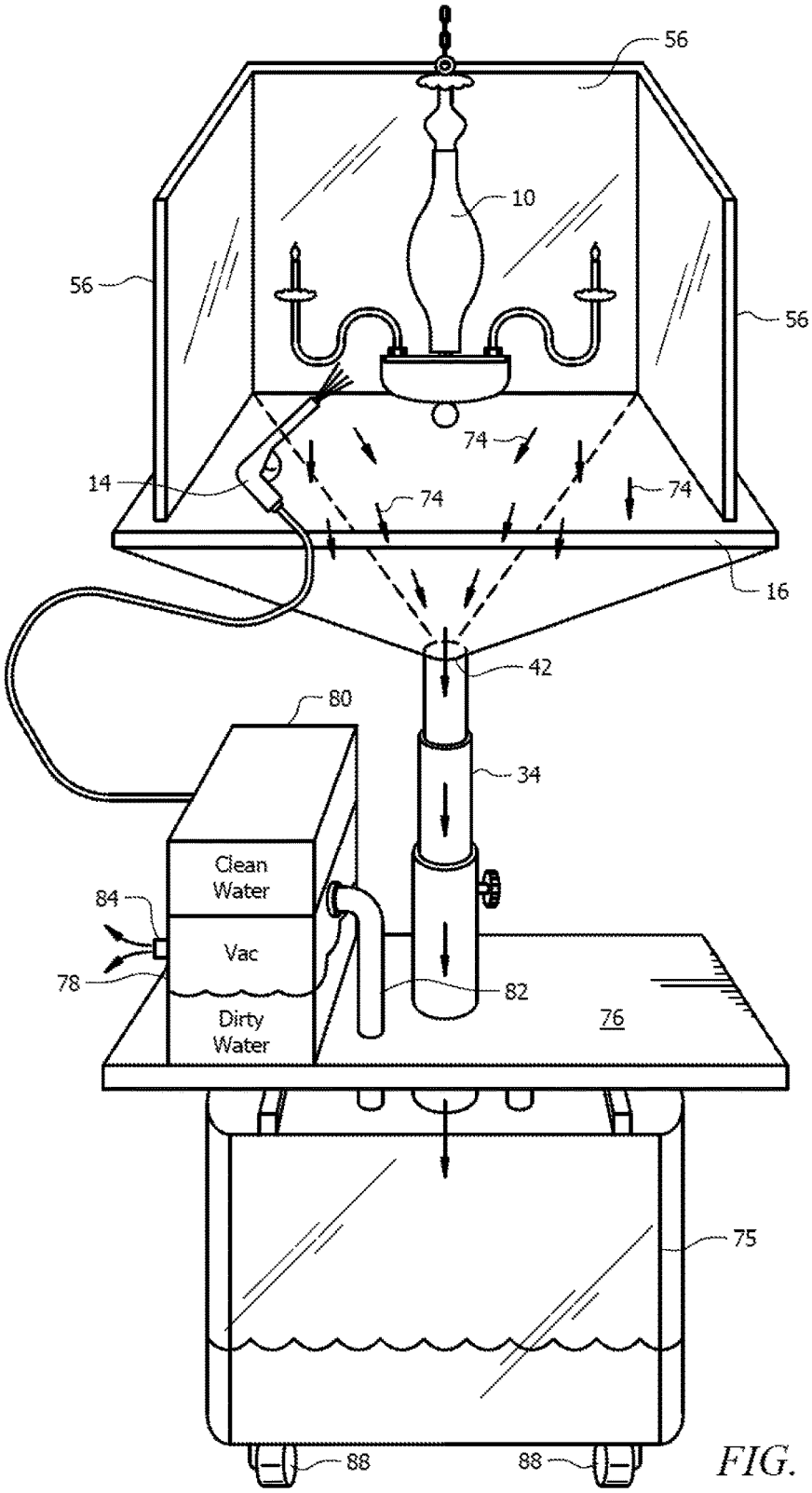
FIG. 13 is a perspective view of a second embodiment of the novel vacuum shield.
Figure 14:
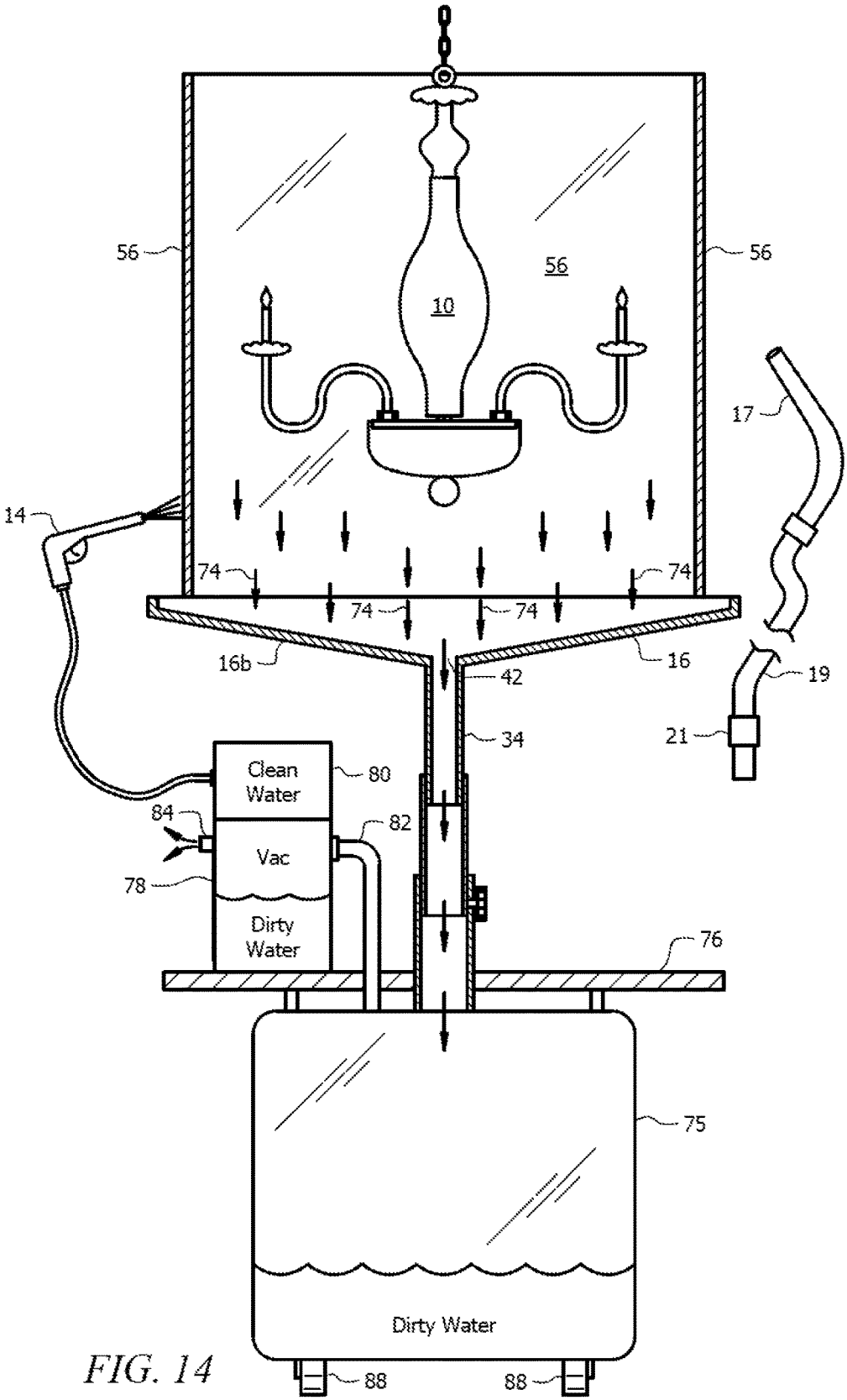
FIG. 14 is a side elevation view of a variation of the second embodiment.

Referring now to FIGS. 13-14, an embodiment of the present invention includes vacuum shield 16 having sloped bottom wall 16*b* leading to drainage aperture/vacuum inlet 42 at a bottom most section of vacuum shield 16. The embodiment further includes a spray shield, in the form of, generally vertical, walls 56, extending upward from vacuum shield 16. Preferably, there are three walls 56 sized to encase chandelier 10 while providing an open area where a fourth wall would have created a square cross-section. The open area allows the user to easily clean chandelier 10 with jet gun 14 while walls 56 provide a backdrop to collect fluid 74 expelled from jet gun 14. Vacuum shield 16 works in conjunction with the spray shield to collect fluid 74 falling towards the ground.

An embodiment may include a spray shield composed of one or more walls having any shape sufficient to provide a backdrop for fluid sprayed onto a chandelier. The spray shield preferably extends at least 180-degrees, but less than 360-degrees with respect to a central vertical axis of vacuum shield 16. An embodiment may include transparent walls 56 to provide a user with a 360-degree view of the chandelier while the chandelier remains partially enclosed by walls 56.

The drain aperture 42 is in communication with telescoping drainage pipe 34 that leads to drainage tank 75. Telescoping drainage pipe 34 allows the device to adjust in height to ensure that the vacuum and spray shields adequately enclose chandelier 10 to ensure that the majority of the fluid is contained by the vacuum and spray shields. Drainage pipe 34 is depicted as having a telescoping structure, but may include any structure adapted to extend in length and maintain an internal and contained lumen between vacuum shield 16 and drainage tank 75.

An embodiment includes table 76 disposed above drainage tank 75 through which drainage pipe 34 may pass. Table 76 provides a structure on which a source of negative pressure (vacuum) 78 may be stored. Table 76 further provides space to accommodate clean water tank 80, jet gun 14, and/or vacuum wand 17.

Drainage tank 75 is preferably in fluid communication with negative pressure source 78 through conduit 82. Negative pressure source 78 further includes an air outlet 84 to dispel air and create the negative pressure. The negative pressure pulls dirty water through drainage aperture 42 into drainage pipe 34 where it is deposited into drainage tank 75. In some instance, the dirty water may pass into conduit 82 and into negative pressure source 78. Therefore, an embodiment of negative pressure source 78 may include an area for receiving dirty water along with an outlet or removal lid (not shown) to empty negative pressure source 78.

Referring now specifically to FIG. 14, an embodiment may include a hand-held vacuum wand 17 in fluid communication with flexible hose 19 and coupler 21. Coupler 21 is configured to mate and create a seal with drainage aperture 42. When coupled to drainage aperture 42, vacuum wand 17 provides a user with a handheld vacuum wand under a negative pressure through negative pressure source 78. Thus, a user can easily maneuver wand 17 to remove water from any section of chandelier 10 without requiring a separate vacuum unit. Coupler 21 may sealingly attach to drainage aperture 42 through any technique known to a person of ordinary skill in the art including, but not limited to, press-fitting and threadly attaching the coupler in place.

An embodiment may include wheels 88 disposed below drainage tank 75 to enable easy relocation of the device. An embodiment includes a drain outlet located in a bottom portion of drainage tank 75, thus providing an option for emptying drainage tank 75 without disassembling the apparatus.

The novel apparatus has many advantages. It enables a chandelier to be cleaned much faster than conventional methods because the user need not touch or remove any of the crystals. Moreover, it cleans areas that cannot be accessed by other cleaning systems or hand-cleaning unless crystals are removed. Crystal removal is very undesirable because chandeliers may have as few as one hundred (100) parts or as many as one hundred thousand (100,000) parts.

The novel method also avoids the use of chemical sprays. Such sprays can break down the lacquer coating that protects the metallic parts of the chandelier, thereby enabling corrosion and darkening of the metallic surfaces over time.

It also eliminates the prior art need to protect light bulbs and electrical sockets to protect them from water, thereby saving even more time.

Selective atomizing of hot water using controlled pressure enables an operator to avoid any area deemed off limits to moisture with the ability to detail and clean areas not accessible by hand or chemical spray bottles. The mist does not leave a chemical residue that can damage lacquer coating and is environmentally safe.

Directional atomizing or misting using water heated to about one hundred forty to one hundred eighty degrees Fahrenheit (140-180° F.) enables heat transfer to the crystals being cleaned, thereby causing rapid evaporation of water from the crystals and other metal parts. When coupled with heated drying air, the crystals are dried quickly.

The introduction of heat, combined with the novel vacuum shield, eliminates the prior art dependence on gravity and the associated limitations of vertical dripping.

The novel vacuum shield catches excess mist, removing it from just below a crystal or other part being cleaned and bringing the excess mist in a controlled manner to a stable container. The container is easy to handle so that the collected excess mist can be poured without spillage into a sink.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for cleaning chandeliers, comprising:

a vacuum shield having drainage surface sloped towards a drainage aperture formed in a lower end of the vacuum shield;

a telescoping drainage pipe having an upper end in fluid communication with the drainage aperture and a lower end in communication with a drainage tank, the telescoping drainage pipe thereby allowing the vacuum shield to be adjusted in height according to the height of a chandelier;

the drainage tank adapted to receive fluid passing through drainage aperture and the drainage pipe;

a spray shield having at least one wall extending upwardly from the vacuum shield, thereby creating a backdrop to contain any fluids sprayed onto a chandelier disposed in overlying relation to the vacuum shield; and whereby the vacuum shield protects objects below the vacuum shield and the spray shield protects objects not disposed between a fluid source and the spray shield from fluid under positive pressure.

2. The apparatus of claim 1, wherein the spray shield includes three interconnected walls creating a backdrop that extends at least 180-degrees, but less than 360-degrees around a chandelier centrally disposed over the vacuum shield.

3. The apparatus of claim 1, wherein the spray shield is transparent, thereby providing an unobstructed view of the chandelier.

4. The apparatus of claim 1, wherein the vacuum shield is an inverted a pyramid-like shape with the drainage aperture located at an inverted peak of the pyramid.

5. The apparatus of claim 1, further comprising a source of negative pressure in communication with the drainage tank thereby creating a vacuum suction at the drainage aperture in the vacuum shield.

6. The apparatus of claim 1, further comprising a hand-held jet gun having a proximal end adapted to be connected to a source of hot water under positive pressure and a distal end having a spray head for discharging hot water under pressure in a spray pattern, whereby an object disposed between the spray head and the spray shield is cleansed by the action of hot water under positive pressure impinging against it.

7. The apparatus of claim 1, further comprising a platform overlying the drainage tank with an aperture sized to receive the drainage pipe as it extends between the vacuum shield and the drainage tank.

8. The apparatus of claim 1, further comprising wheels secured to a bottom end of the drainage tank, thereby enabling the apparatus to be easily rolled to a desired location.

9. The apparatus of claim 1, further comprising an outlet from in a bottom portion of the drainage tank, thereby enabling a user to drain the drainage tank without having to disassemble the apparatus.

10. The apparatus of claim 1, further comprising:

the vacuum shield including a porous, absorbent cushioned pad that overlies the drainage surface;

a plurality of upstanding bristles formed on the cushioned pad;

the bristles operative to suppress splashing of water that impinges against the cushioned pad;

the bristles also operative to channel water impinging upon the cushioned pad to the drainage outlet;

the bristles also operative to remove at least one drop of water from a part being cleaned when the part is contacted by the bristles; and the bristles further operative to cushion a fall of a part that lands atop the bristles.

11. The apparatus of claim 7, further comprising an interior surface of the spray shield being covered with splash-suppressing bristles.

12. The apparatus of claim 4, further comprising:

a vacuum wand secured to a flexible vacuum hose at a proximal end of the vacuum hose;

a coupler secured to a distal end of the vacuum hose, wherein the coupler is configured to be sealingly secured to the drainage aperture in the vacuum shield; and whereby the vacuum wand can be used to vacuum water directly from the chandelier.

13. The apparatus of claim 6, further comprising a clean water supply stored on the platform.

14. An apparatus for cleaning chandeliers, comprising:

a vacuum shield having drainage surface sloped towards a drainage aperture formed in a lower end of the vacuum shield;

a telescoping drainage pipe having an upper end in fluid communication with the drainage aperture and a lower end in communication with a drainage tank, the telescoping drainage pipe thereby allowing the vacuum shield to be adjusted in height according to the height of a chandelier;

the drainage tank adapted to receive fluid passing through drainage aperture and the drainage pipe;

an outlet from in a bottom portion of the drainage tank, thereby enabling a user to drain the drainage tank without having to disassemble the apparatus;

a spray shield having at least one wall extending upwardly from the vacuum shield, thereby creating a backdrop that extends at least 180-degrees, but less than 360-degrees around a chandelier centrally disposed over the vacuum shield to contain any fluids sprayed onto a chandelier;

a source of negative pressure in communication with the drainage tank thereby creating a vacuum suction at the drainage aperture in the vacuum shield;

a hand-held fluid source having a proximal end adapted to be connected to a source of hot water under positive pressure and a distal end for discharging hot water under pressure, whereby an object disposed between the distal end of the fluid source and the spray shield is cleansed by the action of hot water under positive pressure impinging against it; and whereby the vacuum shield protects objects below the vacuum shield and the spray shield protects objects not disposed between the fluid source and the spray shield from fluid under positive pressure.

15. The apparatus of claim 14, wherein the spray shield includes three interconnected walls.

16. The apparatus of claim 14, wherein the spray shield is transparent, thereby providing an unobstructed view of the chandelier.

17. The apparatus of claim 14, wherein the vacuum shield is an inverted a pyramid-like shape with the drainage aperture located at an inverted peak of the pyramid.

18. The apparatus of claim 14, further comprising a platform overlying the drainage tank with an aperture sized to receive the drainage pipe as it extends between the vacuum shield and the drainage tank.

19. The apparatus of claim 14, further comprising wheels secured to a bottom end of the drainage tank, thereby enabling the apparatus to be easily rolled to a desired location.

20. The apparatus of claim 14, further comprising:

a vacuum wand secured to a flexible vacuum hose at a proximal end of the vacuum hose;

a coupler secured to a distal end of the vacuum hose, wherein the coupler is configured to be sealingly secured to the drainage aperture in the vacuum shield; and whereby the vacuum wand can be used to vacuum water directly from the chandelier.

* * * * *